US010591208B2

(12) United States Patent
Mao et al.

(10) Patent No.: US 10,591,208 B2
(45) Date of Patent: Mar. 17, 2020

(54) USER INTERFACE UNIT FOR COOLING APPLIANCE AND COOLING APPLIANCE

(71) Applicant: BSH HAUSGERAETE GMBH, Munich (DE)

(72) Inventors: Xuehua Mao, Nanjing (CN); Xiangfei Yang, Nanjing (CN)

(73) Assignee: BSH Hausgeraete GmbH, Munich (DE)

( * ) Notice: Subject to any disclaimer, the term of this patent is extended or adjusted under 35 U.S.C. 154(b) by 78 days.

(21) Appl. No.: 15/765,281

(22) PCT Filed: Nov. 28, 2016

(86) PCT No.: PCT/IB2016/057148
§ 371 (c)(1),
(2) Date: Apr. 2, 2018

(87) PCT Pub. No.: WO2017/103714
PCT Pub. Date: Jun. 22, 2017

(65) Prior Publication Data

US 2019/0063823 A1 Feb. 28, 2019

(30) Foreign Application Priority Data

Dec. 17, 2015 (CN) ..... 2015 1 0946077

(51) Int. Cl.
*F25D 29/00* (2006.01)
*F25D 23/02* (2006.01)
*F25D 11/00* (2006.01)

(52) U.S. Cl.
CPC ..... *F25D 29/005* (2013.01); *F25D 11/00* (2013.01); *F25D 23/028* (2013.01); (Continued)

(58) Field of Classification Search
CPC ..... F25D 29/005; F25D 23/028; F25D 11/00; F25D 29/003; F25D 2400/06; F25D 2400/361
See application file for complete search history.

(56) References Cited

U.S. PATENT DOCUMENTS 8,011,203 B1 9/2011 Schenk et al.
2011/0146333 A1 6/2011 Koo et al.
(Continued)

FOREIGN PATENT DOCUMENTS

CN 102906517 A 1/2013
DE 102011005737 A1 9/2012
JP 2004044980 A 2/2004

OTHER PUBLICATIONS

Translation JP-2004044980.*

*Primary Examiner* — Elizabeth J Martin
(74) *Attorney, Agent, or Firm* — Laurence A. Greenberg; Werner H. Stemer; Ralph E. Locher

(57) ABSTRACT

A cooling appliance includes a main body, a first door and a second door connected to the main body, and a user interface unit. The first door has a front surface and an inner side portion facing a side surface of the second door. The first door includes an inclined side portion located between the front surface and the inner side portion of the first door. The user interface unit is disposed at the inclined side portion. A user interface unit for a cooling appliance is also provided.

30 Claims, 3 Drawing Sheets

(52) U.S. Cl.
CPC ..... *F25D 29/003* (2013.01); *F25D 2400/06* (2013.01); *F25D 2400/361* (2013.01)

(56) References Cited

U.S. PATENT DOCUMENTS

| | | | | |
|---|---|---|---|---|
| 2011/0273071 | A1* | 11/2011 | Kim | F25D 23/028 312/405 |
| 2014/0145579 | A1 | 5/2014 | Anderson et al. | |
| 2015/0247668 | A1* | 9/2015 | Willis | F25B 49/02 62/129 |

* cited by examiner

USER INTERFACE UNIT FOR COOLING APPLIANCE AND COOLING APPLIANCE

BACKGROUND OF THE INVENTION

Field of the Invention

The present invention relates to a user interface unit and a cooling appliance, and in particular, to a user interface unit for a cooling appliance and a cooling appliance having a door provided with a user interface unit.

Description of the Related Art

CN102906517A discloses a cooling appliance with a user interface. The cooling appliance includes a pair of doors, and each door includes an outer surface exposed to an outer environment of the cooling appliance, an inner part exposed to a storage compartment, and a side part extending between the outer surface and the inner part. When the two doors are closed, the two side parts are opposite to each other. The user interface is provided on a side part of at least one door. On this basis, a cooling appliance with a hidden user interface is provided.

However, a user needs to open a door and keep the door open to view and/or operate the user interface, which causes unnecessary energy waste.

SUMMARY OF THE INVENTION

An objective of the present invention is to overcome at least one technical problem in the prior art, to provide an improved cooling appliance and a user interface unit for a cooling appliance.

The foregoing objective can be achieved by means of characteristics in independent claims. Preferred embodiments of the present invention are the subject of accompanying drawings, the specification, and dependant claims.

An aspect of the present invention relates to a cooling appliance. The cooling appliance includes a main body; a first door and a second door connected to the main body, where the first door has a front surface and an inner side portion facing a side surface of the second door; and a user interface unit, characterized in that the first door includes an inclined side portion located between the front surface and the inner side portion of the first door, and the user interface unit is disposed at the inclined side portion.

Therefore, a user may view or operate the user interface unit located between the first door and the second door, without opening the first door or the second door, which not only increases convenience of use of the cooling appliance, but also reduces a quantity of times of opening the door by the user. In addition, the appearance of the cooling appliance according to the present invention may be significantly different from that of an existing cooling appliance as well.

Another aspect of the present invention relates to a cooling appliance. The cooling appliance includes a main body; a first door connected to the main body, where the first door includes a front surface and an inner side portion perpendicular to the front surface; and a user interface unit, characterized in that the first door includes an inclined side portion located between the front surface and the inner side portion of the first door, and the user interface unit is disposed at the inclined side portion.

Therefore, a user may stand in the front of the first door to view or operate the user interface unit disposed on one side of the first door, which helps provide a novel cooling appliance without affecting convenience of use of the cooling appliance. Further, when the cooling appliance has a second door opposite to the inner side portion of the first door, this advantage is more obvious. For example, a user may view or operate the user interface unit disposed on the side of the first door, without opening the second door.

It should be understood that the present invention is applicable to various cooling appliances having different structures, and should not be limited to the preferred embodiments disclosed in the present invention. For example, the present invention is applicable to a side-by-side refrigerator or a wine cooler having a first storage compartment and a second storage compartment that are arranged side by side, is applicable to a refrigerator or a wine cooler having a first storage compartment and second storage compartment that are vertically arranged, and is also applicable to a refrigerator or a wine cooler whose a pair of doors close a same storage compartment.

It should be understood that in an embodiment, the inner side portion and the inclined side portion that are described in the present invention are located on a longitudinal side of the first door; therefore, the user interface unit may be disposed on the longitudinal side of the first door. This embodiment is applicable to, especially, a cooling appliance having a first door and a second door that are transversally disposed. However, in another embodiment, the inner side portion and the inclined side portion that are described in the present invention are located on a traversal side of the first door; therefore, the user interface unit is disposed on the transversal side of the first door. This implementation solution is applicable to, especially, a cooling appliance having a first door and a second door that are vertically arranged.

In a possible embodiment, an angle between the inclined side portion and the front surface is between 30° and 60°.

In a possible embodiment, the inclined side portion has a recess portion for accommodating at least one part of the user interface unit, and the user interface unit includes an interface panel for enclosing an entrance of the recess portion.

In a possible embodiment, the inclined side portion includes a base surface portion exposed to an outside; the recess portion is recessed inward from the base surface portion; and the base surface portion is basically flush with the interface panel. It should be understood that "the base surface portion is substantially flush with the interface panel" described in the present invention may have two embodiments: in one embodiment the base surface portion is flush with the interface panel; and in another embodiment the base surface portion is substantially flush with the interface panel. In the another embodiment the interface panel can be slightly not flush with the base surface portion due to a manufacturing tolerance.

In a possible embodiment, a step portion is formed between the inner side portion and the entrance, and the user interface unit includes a bending portion that extends backwards from the interface panel and is rested on the step portion.

Although there may be an angle between a front wall or a rear wall and the front surface, in a preferred embodiment, the recess portion includes a front wall and a rear wall that are substantially parallel to the front surface, which is very convenient for manufacturing of side covers of the inner side portion and the inclined side portion. When in an embodiment the side cover is a component formed by means of injection molding and the side cover is further provided with a handle groove or another groove, the side cover can be more easily detached from a modeling. Therefore, recess portions disposed in such a manner enable handle grooves or other recesses to have the same pattern draft.

In a possible embodiment, the first door includes a front door panel; at least the most part of the front surface is formed by the front door panel; and the front wall 5 is connected to a rear surface of the front door panel. "At least the most part of the front surface is formed by the front door panel" should cover an embodiment in which the front surface is completely formed by the front door panel and another embodiment in which the most part of the front surface is formed by the front door panel.

In a possible embodiment, the user interface unit includes a peripheral wall extending from an inner side of the interface panel into the recess portion, and an angle between the peripheral wall and the interface panel is less than 90°.

In a possible embodiment, the peripheral wall is at least substantially parallel to the front surface. It should be understood that "the peripheral wall is at least substantially parallel to the front surface" may cover two embodiments: in an embodiment the peripheral wall can be parallel to the front surface; and in another embodiment the peripheral wall is substantially parallel to the front surface.

In a possible embodiment, the angle between the peripheral wall and the interface panel is basically equal to an angle between the inclined side portion and the front surface.

In a possible embodiment, the user interface unit includes a pair of peripheral walls, where each peripheral wall is parallel to and is in snap-fit connection to corresponding one of a front wall and a rear wall of the recess portion.

In a possible embodiment, the second door includes a second front surface, a second inner side portion facing the inner side portion of the first door, and a second inclined side portion located between the second front surface and the second inner side portion.

In a possible embodiment, an angle between the inclined side portion and the front surface of the first door is equal to an angle between the second inclined side portion and the second front surface.

In a possible embodiment, the first door further includes a handle groove located between the front surface and the inner side portion, and the handle groove and the user interface unit are vertically arranged along a height direction of the first door.

Still another aspect of the present invention relates to a user interface unit for a cooling appliance. The user interface unit includes: an interface panel and an electrical component fixed to an inner side of the interface panel, characterized by including: a pair of opposite and parallel peripheral walls, where the electrical component is located between the peripheral walls, and an angle between each of the peripheral walls and the interface panel is less than 90°.

Therefore, even if the user interface unit is installed at the inclined side portion of the cooling appliance, the user interface unit may be conveniently installed on the cooling appliance.

In a possible embodiment, the user interface unit includes a fixing portion for fixing the electrical component; the fixing portion is adjacent to a corresponding peripheral wall; and an angle is formed between the fixing portion and the corresponding peripheral wall.

Other independent characteristics or those characteristics that are considered as features of the present invention through combination with other characteristics will be described in the following appended claims.

The structure of the present invention and other invention objectives and beneficial effects of the present invention become more comprehensible through the description of preferred embodiments with reference to the accompanying drawings.

BRIEF DESCRIPTION OF THE SEVERAL VIEWS OF THE DRAWING

As a part of this specification and for further understanding of the present invention, the following accompanying drawings describe specific implementation manners of the present invention, and are used to describe the principle of the present invention together with the specification.

DESCRIPTION OF THE INVENTION

Figure 1:
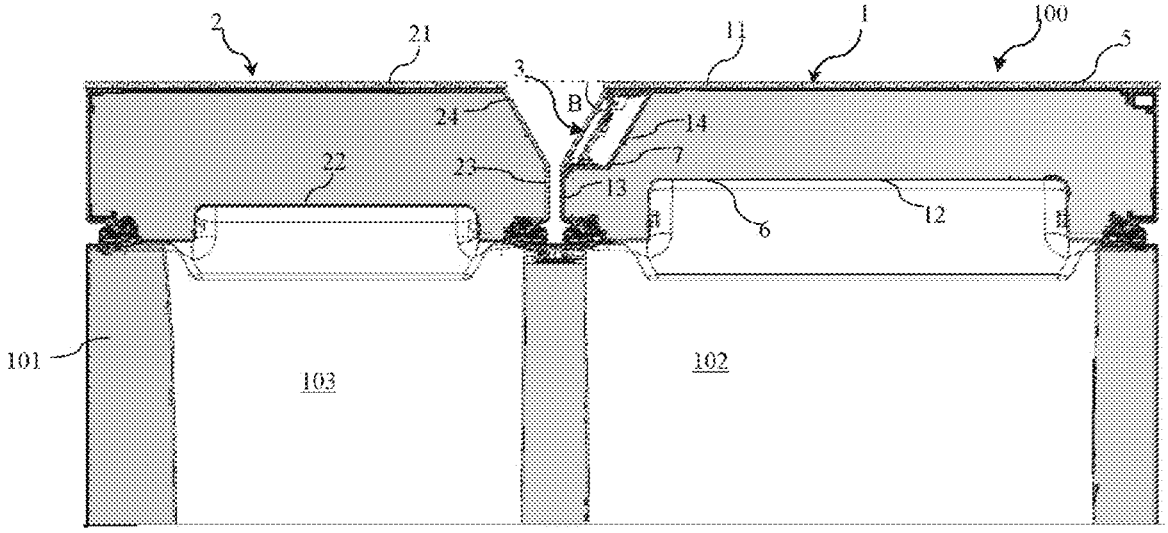
FIG. 1 is a schematic partial cross-sectional view of a cooling appliance according to a preferred embodiment of the present invention.

FIG. 1 is a schematic partial cross-sectional view of a cooling appliance 100 according to a preferred embodiment of the present invention. As shown in FIG. 1, the cooling appliance 100 includes a main body 101 having a plurality of storage compartments 102, 103, and a first door 1 and a second door 2 that are connected to the main body 101 to close a corresponding storage compartment respectively. The first door 1 and the second door 2 are hinged to a corresponding opposite side of the main body 101 respectively. It should be understood that the present invention is not limited to the specific configuration of the cooling appliance 100, but is applicable to a cooling appliance having other configurations. For example, the first door 1 and the second door may close a corresponding part of a same storage compartment respectively.

The first door 1 has a front surface 11, a rear surface 12, and an inner side portion 13. When the first door 1 is closed, the rear surface 12 faces the storage compartment 102 closed by the first door 1, and the inner side portion 13 directly faces a side surface of the second door 2 when the first door 1 and the second door 2 are closed.

The first door 1 includes a front panel 5 to form at least a most part of the front surface 11, and a rear panel 6 to form at least the most part of the rear surface 12.

Similarly, the second door 2 has a second front surface 21, a second rear surface 22, and a second inner side portion 23. The second rear surface 22 is faced to the storage compartment 103 when the second door 2 is closed, and the second inner side portion 23 is directly faced to the inner side portion 13 of the first door 1 when the first door 1 and the second door 2 are closed.

In an embodiment, the inner side portion 13 and the second inner side portion 23 may be basically perpendicular to the front surface 11 and the second front surface 21 of the first door 1 respectively.

The inner side portion 13 only occupies a part of the thickness of the first door 1 in a front-rear direction. Therefore, the first door 1 includes an inclined side portion 14 located between the front surface 11 and the inner side portion 13 of the first door 1. In a direction from the rear surface 12 to the front surface 11 of the first door 1, the inclined side portion 14 inclines in a direction of away from the second door 2. Therefore, in a direction from back to front, a distance between the first door 1 and the second door 2 gradually increases.

The inner side portion 13 and the inclined side portion 14 may be formed by a side profile member 7 extending along corresponding sides of the front panel 5 and the rear panel 6.

Similarly, the second door 2 includes a second inclined side portion 24 located between the second front surface 21 and the second inner side portion 23. In a direction from the second rear surface 22 to the second front surface 21, the second inclined side portion 24 inclines in a direction of away from the first door 1.

Distances from the second inner side portion 23 and the inner side portion 13 to the front or back may be approximate or the same. An angle C between the inclined side portion 14 and the front surface 11 of the first door 1 may be equal to an angle (not shown) between the second inclined side portion 24 and the second front surface 21. Therefore, in a direction from back to front, a distance between the inclined side portion 14 and the second inclined side portion 24 increases likes an antiparallelogram.

The inner side portion 13 and the second inner side portion 23 may respectively extend along the entire heights of the first door 1 and the second door 2.

Figure 2:
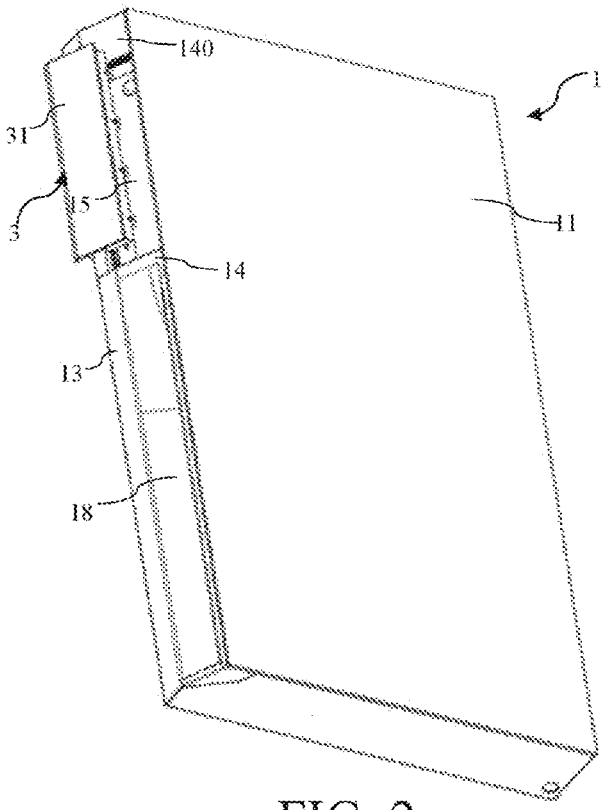
FIG. 2 is a schematic three-dimensional view of a first door of the cooling appliance according to a preferred embodiment of the present invention.

As shown in FIG. 1 and FIG. 2, the first door 1 includes a user interface unit 3 disposed at the inclined side portion 14. Because the user interface unit 3 is disposed at the inclined side portion 14 of the first door 1, it is possible for the front surface 11 of the first door 1 not to be provided with a user interface; and on the other hand, a user may operate and/or view the user interface unit 3 without opening the first door 1 or the second door 2.

Therefore, the first door 1 may further include a handle groove 18 located between the front surface 11 and the inner side portion 13 of the first door 1. In this embodiment, the handle groove 18 and the user interface unit 3 may be vertically arranged along a height direction of the first door 1.

The user interface unit 3 may be configured to receive information input by a user or output information to a user. The user interface unit 3 may include an output unit for outputting information (for example, setting information of the cooling appliance 100 and/or information about foods stored in the cooling appliance 100, or information irrelevant to the cooling appliance, such as a video/picture) to a user and/or an input unit for receiving an input instruction of a user. The output unit may include, for example, a display apparatus and/or a light source. The input unit may include, for example, a touch sensing unit and/or at least one mechanical input apparatus.

Figure 3:
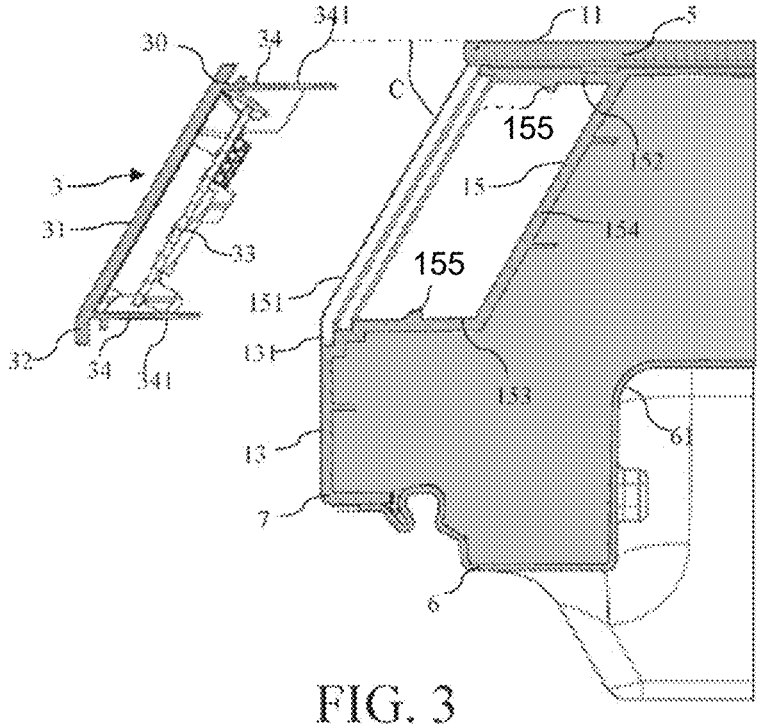
FIG. 3 is a schematic partial cross-sectional view of the first door on which a user interface unit has not been installed according to a preferred embodiment of the present invention.

Referring to FIG. 1 to FIG. 3, the inclined side portion 14 has a base surface portion 140 exposed to a user, and a recess portion 15 recessed inward from the base surface portion 140 to accommodate at least a part of the user interface unit 3. An angle C formed between the base surface portion 140 and the front surface 11 is not equal to 90°, and the angle C may between 30° and 60°.

The user interface unit 3 includes an interface panel 31 for enclosing an entrance 151 of the recess portion 15, and an electrical component 33 that is at least partially located in the recess portion 15.

A user may perform an operation on the interface panel 31 (such as touching or pressing the interface panel 31) to input an instruction into the cooling appliance 100 or view information. In a preferred embodiment, the interface panel 31 may be basically flush with the base surface portion 140 of the inclined side portion 14.

The electrical component 33 may include electrical elements such as a printed circuit board, a display unit, and/or an input apparatus.

In this embodiment, the electrical component 33 is fixed to an inner side of the interface panel 31. In an embodiment, the electrical component 33 may be preassembled in the interface panel 31 and then the electrical component 33 and the interface panel 31 are installed on the inclined side portion 14 together. The user interface unit 3 includes a support component 30 that is made of plastic, for supporting the electrical component 33. The interface panel 31 forms a part of the support component 30.

In an alternative embodiment, after the electrical component 33 is fixed to the recess portion 15, the interface panel 31 is then installed on the inclined side portion 14.

A step portion 131 may be formed between the inner side portion 13 and the entrance 151 of the recess portion 15. The support component 30 may include a bending portion 32 that extends backwards from a rear end of the interface panel 31 and is rested on the step portion 131. A rear end surface of the bending portion 32 faces the step portion 131, which helps dispose, at a position less visible to a user, a seam that is between the user interface unit 3 and the inner side portion 13. Preferably, the bending portion 32 is flush with the inner side portion 13.

The recess portion 15 includes a front wall 152 and a rear wall 153 that are substantially parallel to the front surface 11. The front wall 152 may extend along a rear surface of the front panel 5. In this embodiment, the front wall 152 and the rear wall 153 are at least substantially parallel to the front surface 11. A bottom wall 154 of the recess portion 15 is parallel to the entrance 151, and an angle greater than 90° is formed between the bottom wall 154 and the front surface 11, which help to reduce an impact of the recess portion 15 on the thickness of an insulation layer of the first door 1, especially, an impact on the thickness of an insulation layer between the bottom wall 154 and a corner 61 of the rear panel 6.

Figure 4:
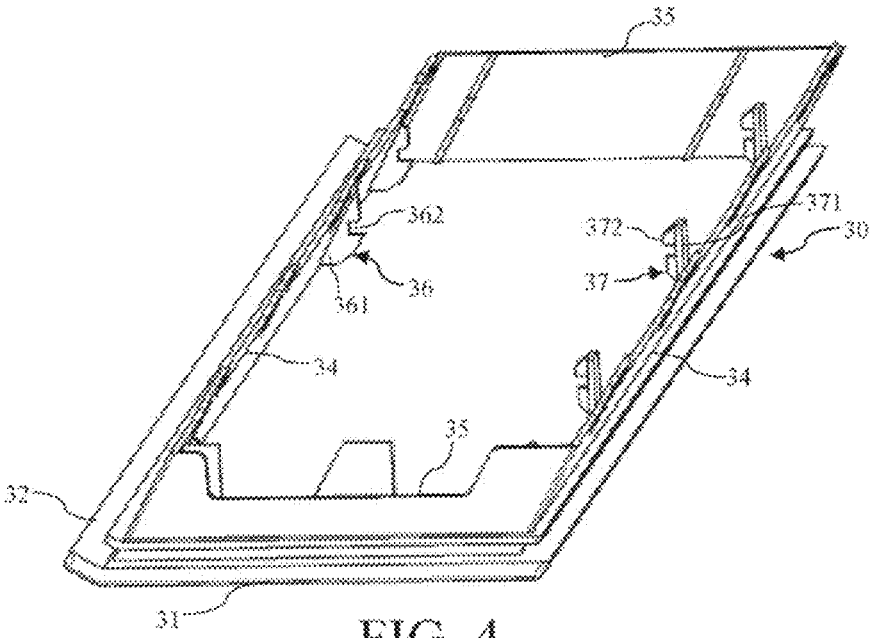
FIG. 4 is a schematic three-dimensional view of a support component of the user interface unit according to a preferred embodiment of the present invention.
Figure 5:
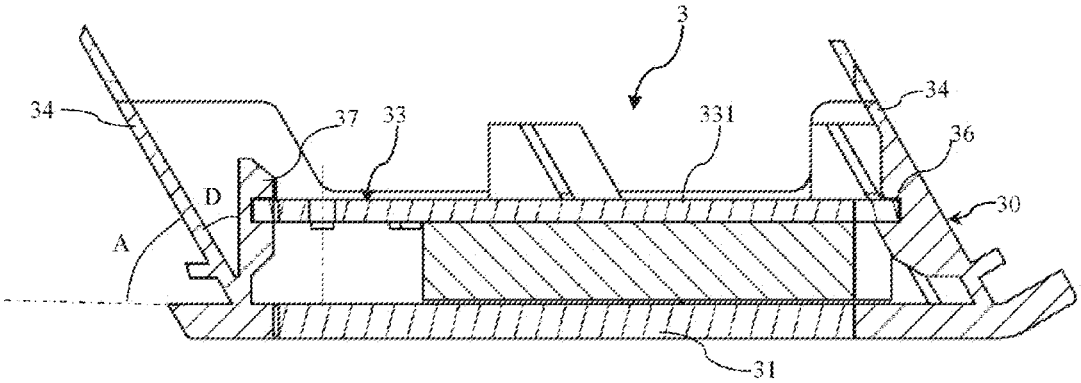
FIG. 5 is a schematic cross-sectional view of the user interface unit according to a preferred embodiment of the present invention.

Referring to FIG. 3 to FIG. 5, the support component 30 includes a pair of peripheral walls 34 that are parallel to each other and extend from the inner side of the interface panel 31 into the recess portion 15, and the electrical component 33 is located between the peripheral walls. The user interface unit 3 further includes a pair of second peripheral walls 35 connecting the pair of peripheral walls 34, so as to surround the electrical component 33, which helps prevent the electrical component 33 from foreign materials such as water and/or dust.

An angle A between each peripheral wall 34 and the interface panel 31 is less than 90°. In this embodiment, the peripheral walls 34 are at least substantially parallel to the front surface 11. The angle A between each peripheral wall 34 and the interface panel 31 is basically equal to an angle B between the interface panel 31 and the front surface 11, and is basically equal to the angle C between the base surface portion 151 and the front surface 11 as well.

Each peripheral wall 34 is parallel to and is in snap-fit connection with corresponding one of the front wall 152 and the rear wall 153 of the recess portion 15. In this embodiment, each peripheral wall 34 may include a plurality of through holes 341, and the front wall 152 and the rearwall 153 may be provided with a plurality of protrusions 155 respectively.

When the user interface unit 3 is pushed into the recess portion 15 along a direction parallel to the front surface 11, the protrusions 154 are snap fit into corresponding through holes 341. Therefore, the user interface unit 3 is securely fixed to the inclined side portion 14.

The electrical component 33 may include a printed circuit board 331, and the support component 30 includes a fixing mechanism for fixing the printed circuit board 331. The fixing mechanism includes multiple first fixing portions 36 for clamping one side of the printed circuit board 331, and multiple second fixing portions 37 for hooking the other side of the printed circuit board 331.

The first fixing portion 36 includes a board-shaped main body wall 361 that is connected to an inner side of the peripheral wall 35 and extends towards the other peripheral wall 34, and a clamping groove 362 recessed from an end of the main body wall 361. The main body wall 361 may be perpendicular to the peripheral wall 35. The clamping groove 362 may be parallel to the interface panel 31.

The second fixing portion 37 is connected to the inner side of the interface panel 31 and extends towards the recess portion 15 or extends inward from a root of a peripheral wall 34. A clamping hook 37 includes an elastic connecting leg 371 perpendicular to the interface panel 31, and a hook portion 372 connected to a bottom end of the connecting leg 371 to hook another side of the printed circuit board 331. The second fixing portion 37 may also have a clamping groove.

The second fixing portion 37 is near the corresponding peripheral wall 34, and an angle D formed between the connecting leg 371 and the peripheral wall 34 is greater than 0°. Preferably, a sum of the angle D and the angle A between the peripheral wall 34 and the interface panel 31 is basically equal to 90°.

In an alternative embodiment, two sides of the printed circuit board 331 are both clamped by clamping grooves or are hooked by clamping hooks, or two sides of the printed circuit board 331 are both provided with clamping grooves and the clamping hooks.

In the foregoing embodiment, the user interface unit may be disposed on a longitudinal side of the first door disposed on the left or right of the second door. The present invention should not be limited thereto, and there may be another embodiment. In another the embodiment, the user interface unit may also be disposed on a traversal side (such as an upper side or a lower side of the first door) of the first door disposed above or below the second door.

In another embodiment, the user interface unit may also be disposed at the inclined side portion of the first door, where the cooling appliance does not have another door opposite to the inclined side portion. Specifically, a cooling appliance may have a first door, where the first door has an inclined side portion that is located between a front surface and an inner side portion perpendicular to the front surface, and a user interface unit is disposed at the inclined side portion. Therefore, the inclined side portion may be located, for example, on the top or on a left side or right side of the first door, and the cooling appliance does not have a door adjacent to the top or left side or right side of the first door.

The embodiments for describing each single part with reference to FIG. 1 to FIG. 5 may be combined in any given manner to achieve the advantages of the present invention. In addition, the present invention is not limited to the shown embodiments, and generally means other than the shown means may be used, as long as they can achieve the same effect.

What is claimed is:

1. A cooling appliance, comprising:

a main body;

a first door and a second door connected to said main body and movable between open and closed positions;

said second door having a side surface;

said first door having a front surface, an inner side portion facing said side surface of said second door in said closed positions of said doors, and an inclined side portion located between said front surface and said inner side portion and being accessible to a user in said closed positions of said doors; and a user interface unit disposed at said inclined side portion.

2. The cooling appliance according to claim 1, wherein said inclined side portion and said front surface enclose an angle of 30° to 60° therebetween.

3. The cooling appliance according to claim 1, wherein said inclined side portion has a recess portion for accommodating at least a part of said user interface unit, and said user interface unit includes an interface panel for enclosing an entrance of said recess portion.

4. The cooling appliance according to claim 3, wherein said inclined side portion includes a base surface portion exposed to an outside, said recess portion (15) is recessed inward from said base surface portion, and said base surface portion is flush with said interface panel.

5. The cooling appliance according to claim 3, which further comprises a step portion formed between said inner side portion and said entrance, said user interface unit including a bending portion extending backwards from said interface panel and resting on said step portion.

6. The cooling appliance according to claim 3, wherein said recess portion includes a front wall and a rear wall being parallel to said front surface.

7. The cooling appliance according to claim 6, wherein said first door includes a front door panel having a rear surface, at least a majority of said front surface is formed by said front door panel, and said front wall is connected to said rear surface of said front door panel.

8. The cooling appliance according to claim 3, wherein said interface panel has an inner side, said user interface unit includes a peripheral wall extending from said inner side of said interface panel into said recess portion, and said peripheral wall and said interface panel enclose an angle of less than 90° therebetween.

9. The cooling appliance according to claim 8, wherein said peripheral wall is parallel to said front surface.

10. The cooling appliance according to claim 8, wherein said angle enclosed between said peripheral wall and said interface panel is equal to an angle enclosed between said inclined side portion and said front surface.

11. The cooling appliance according to claim 8, wherein said recess portion has a front wall and a rear wall, and said peripheral wall is one of a pair of peripheral walls each being parallel to and snap-fit connected with a corresponding one of said front and rear walls of said recess portion.

12. The cooling appliance according to claim 1, wherein said second door includes a second front surface, a second inner side portion facing said inner side portion of said first door, and a second inclined side portion located between said second front surface and said second inner side portion.

13. The cooling appliance according to claim 12, wherein an angle enclosed between said inclined side portion and said front surface of said first door is equal to an angle enclosed between said second inclined side portion and said second front surface of said second door.

14. The cooling appliance according to claim 1, wherein said first door has a handle groove located between said front surface and said inner side portion, and said handle groove and said user interface unit are vertically disposed along a height direction of said first door.

15. A cooling appliance, comprising:

a main body;

a first door connected to said main body, said first door including a front surface, an inner side portion perpendicular to said front surface, and an inclined side portion located between said front surface and said inner side portion and being accessible to a user standing in front of said first door; and a user interface unit disposed at said inclined side portion.

16. The cooling appliance according to claim 15, wherein said inclined side portion and said front surface enclose an angle of 30° to 60° therebetween.

17. The cooling appliance according to claim 15, wherein said inclined side portion has a recess portion for accommodating at least a part of said user interface unit, and said user interface unit includes an interface panel for enclosing an entrance of said recess portion.

18. The cooling appliance according to claim 17, wherein said inclined side portion includes a base surface portion exposed to an outside, said recess portion is recessed inward from said base surface portion, and said base surface portion is flush with said interface panel.

19. The cooling appliance according to claim 17, which further comprises a step portion formed between said inner side portion and said entrance, said user interface unit including a bending portion extending backwards from said interface panel and resting on said step portion.

20. The cooling appliance according to claim 17, wherein said recess portion includes a front wall and a rear wall being parallel to said front surface.

21. The cooling appliance according to claim 20, wherein said first door includes a front door panel having a rear surface, at least a majority of said front surface is formed by said front door panel, and said front wall is connected to said rear surface of said front door panel.

22. The cooling appliance according to claim 17, wherein said interface panel has an inner side, said user interface unit includes a peripheral wall extending from said inner side of said interface panel into said recess portion, and said peripheral wall and said interface panel enclose an angle of less than 90° therebetween.

23. The cooling appliance according to claim 17, wherein said peripheral wall is parallel to said front surface.

24. The cooling appliance according to claim 17, wherein said angle enclosed between said peripheral wall and said interface panel is equal to an angle enclosed between said inclined side portion and said front surface.

25. The cooling appliance according to claim 17, wherein said recess portion has a front wall and a rear wall, and said peripheral wall is one of a pair of peripheral walls each being parallel to and snap-fit connected with a corresponding one of said front and rear walls of said recess portion.

26. The cooling appliance according to claim 15, wherein said second door includes a second front surface, a second inner side portion facing said inner side portion of said first door, and a second inclined side portion located between said second front surface and said second inner side portion.

27. The cooling appliance according to claim 26, wherein an angle enclosed between said inclined side portion and said front surface of said first door is equal to an angle enclosed between said second inclined side portion and said second front surface of said second door.

28. The cooling appliance according to claim 15, wherein said first door has a handle groove located between said front surface and said inner side portion, and said handle groove and said user interface unit are vertically disposed along a height direction of said first door.

29. A user interface unit for a cooling appliance having a door, the user interface unit comprising:

an interface panel having an inner side, said interface panel being configured to be mounted on a user-accessible inclined side portion of the door located between a front surface of the door and an inner side portion of the door;

a pair of mutually opposite and mutually parallel peripheral walls;

each of said peripheral walls and said interface panel enclosing an angle therebetween of less than 90°; and an electrical component fixed to said inner side of said interface panel and disposed between said peripheral walls.

30. The user interface unit according to claim 29, which further comprises a fixing portion for fixing said electrical component, said fixing portion being adjacent a corresponding one of said peripheral walls, and said fixing portion and said corresponding peripheral wall enclosing an angle therebetween.

* * * * *